US005311758A

United States Patent [19]

Neitzke et al.

[11] Patent Number: 5,311,758

[45] Date of Patent: May 17, 1994

[54] KEY STORAGE TAG

[75] Inventors: William J. Neitzke; G. Lynn Hagen, both of Paradise Valley, Ariz.

[73] Assignee: Axxess-Entry Technologies, Tempe, Ariz.

[21] Appl. No.: 991,310

[22] Filed: Dec. 16, 1992

[51] Int. Cl.[5] ..... A47G 29/10

[52] U.S. Cl. ..... 70/456 R; 70/457; 70/458; 70/460; 206/813; 206/37.1; 206/459.5

[58] Field of Search ..... 40/330, 634; 206/813, 206/37.1, 450.5; 70/456 R, 457, 458, 459, 460, 408

[56] References Cited

U.S. PATENT DOCUMENTS

| | | | |
|---|---|---|---|
| Re. 32,914 | 5/1989 | Almblad | 70/458 |
| 1,425,089 | 8/1922 | Henry . | |
| 1,682,755 | 9/1928 | Hollar et al. . | |
| 1,705,258 | 3/1929 | Lorber . | |
| 1,966,550 | 7/1934 | Handy | 240/2.25 |
| 1,999,660 | 4/1935 | Mosley et al. | 206/46 |
| 2,138,309 | 11/1938 | Stevenson | 40/2 |
| 2,231,308 | 2/1941 | Walsh | 24/252 |
| 2,327,433 | 8/1943 | Johnson | 40/2.2 |
| 2,432,498 | 12/1947 | Bloomfield | 40/2 |
| 2,552,699 | 5/1951 | Warfield | 150/40 |
| 2,672,044 | 3/1954 | Martin | 206/37.1 |
| 3,228,395 | 1/1966 | Gewecke | 206/459.5 |
| 3,933,017 | 1/1976 | Shee | 70/456 R |
| 4,305,267 | 12/1981 | Nish et al. | 70/395 |
| 4,307,590 | 12/1981 | Friedland | 206/37.1 |
| 4,322,002 | 3/1982 | Iten | 206/459.5 |
| 4,677,835 | 7/1987 | Almblad | 70/456 |
| 4,716,400 | 12/1987 | Kuribayashi | 340/572 |
| 4,901,547 | 2/1990 | Dal Palu | 70/456 R |
| 4,936,123 | 6/1990 | Matsuda | 70/456 R |
| 4,941,335 | 7/1990 | Allen | 70/458 |
| 4,944,171 | 7/1990 | Oliana | 70/456 R |
| 4,946,030 | 7/1990 | Guridi et al. | 206/37.1 |
| 4,959,983 | 10/1990 | Hsu | 70/456 R |
| 4,986,421 | 1/1991 | Lipsitz | 206/459.5 |
| 5,045,343 | 9/1991 | Miwa | 70/408 |
| 5,083,662 | 1/1992 | Bishop et al. | 206/37.1 |
| 5,180,192 | 1/1993 | Herbert | 40/634 |
| 5,232,528 | 8/1993 | Reznickenko et al. | 40/330 |

FOREIGN PATENT DOCUMENTS

| | | | |
|---|---|---|---|
| 0385935 | 9/1990 | European Pat. Off. | 70/456 R |
| 1527145 | 4/1968 | France | 70/353 |
| 2084454 | 4/1982 | United Kingdom | A47G 29/10 |

*Primary Examiner*—Peter M. Cuomo
*Assistant Examiner*—Darnell M. Boucher
*Attorney, Agent, or Firm*—Cahill, Sutton & Thomas

[57] ABSTRACT

A key storage tag facilitates storage of a key blank. The key storage tag includes a tag main body, a key to tag interface, a junction body and a hinge. The hinge enables the tag main body to be deflected between a key blank storage configuration where the tag main body is positioned substantially parallel with the key blank and a key duplication configuration where the tag main body is deflected away and separated from the lower surface of the key blank.

28 Claims, 2 Drawing Sheets

KEY STORAGE TAG

BACKGROUND OF THE INVENTION

1. Field of the Invention

This invention relates to key storage devices, and more particularly, to key storage devices which can remain attached to a key blank during key duplicating operations.

2. Description of the Prior Art

In a typical prior art locksmith operation, key blanks are stored on multi-panel, carousal storage racks where each panel includes a series of horizontally protruding hooks for holding key blanks having varying geometry.

Over a period of time, the locksmith depletes his inventory of particular key blanks and orders replacements. The replacement key blanks typically arrive in plastic baggies each of which includes a number of identical key blanks. The locksmith then must open each baggie, remove the group of identical key blanks, locate the proper key blank carousel hook and thereby restock his inventory of key blanks.

The foregoing procedure is time consuming and subject to error, particularly the step of matching the new key blank inventory with the particular key blank hook.

SUMMARY OF THE INVENTION

It is therefore a primary object of the present invention to provide a key storage tag for handling key blanks of a wide variety of sizes or shapes on a key storage tag having a standardized size and shape.

Another object of the present invention is to provide a key storage tag dimensioned to be vertically stacked inside a key storage container having a standardized size, shape and internal storage volume.

Another object of the present invention is to provide a key storage tag readily convertible between a key blank storage configuration for storing key blanks and a key duplication configuration where the key storage tag remains attached to the key blank but allows the key blank to interface with a key cutting machine to duplicate a master key bit pattern onto the key blank.

Another object of the present invention is to provide a key storage tag for indicating to a user of a key cutting machine the proper up or down orientation of the key blank relative to the key cutting machine.

Another object of the present invention is to provide a key storage tag capable of accepting a key blank numbering system and UPC code for facilitating selection of proper key blanks and control of key blank inventory.

Briefly stated, and in accord with one embodiment of the invention, a key storage tag stores key blanks having a defined area, a head with upper and lower surfaces and a blade with upper and lower surfaces in a key storage container. The key storage container includes an internal storage cavity having a defined cross sectional area. The key storage tag includes a longitudinal axis and a substantially planar tag main body. The tag main body has a first area with a perimeter dimensioned to fit within the storage cavity of the key storage container and includes first and second spaced apart linear junction elements. A key to tag interface includes a second area as well as means for detachably coupling the interface to the lower surface of the key head. The key to tag interface includes a third junction element. A junction body includes a third area and a linear junction surface which defines a lateral axis perpendicular to the longitudinal axis of the key storage tag. The junction surface includes first and second junction segments for joining the junction body to the first and second junction elements of the tag main body. The junction body further includes a third junction segment for joining the junction body to the third junction element of the key to tag interface. A hinge is aligned with the lateral axis of the key storage tag for enabling the tag main body to be deflected between a key blank storage configuration where the tag main body is positioned substantially parallel to the key blank and a key duplication configuration where the tag main body is deflected away and separated from the lower surface of the key blank.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred hardware embodiment of the invention will now be described in some detail.

Figure 1:
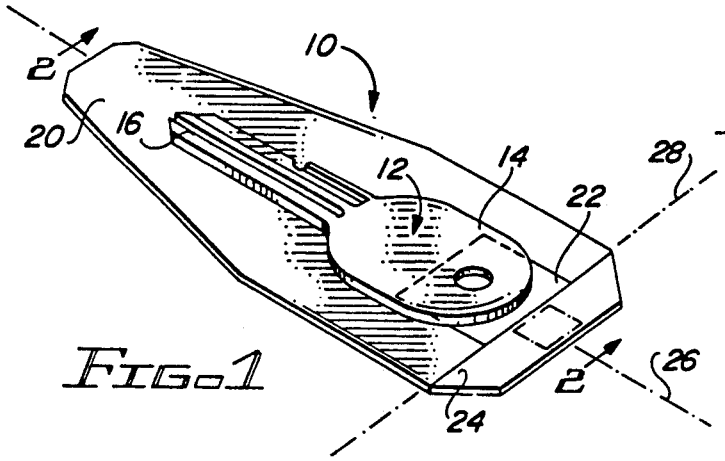
FIG. 1 is a perspective view of a key storage tag of the present invention showing the key storage tag in the key blank storage configuration.
Figure 2:
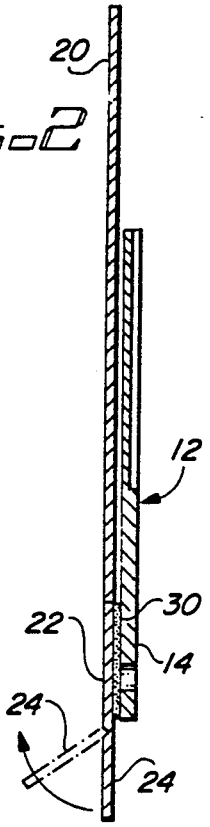
FIG. 2 is a sectional view of the key storage tag illustrated in FIG. 1, taken along section lines 2—2.
Figure 3:
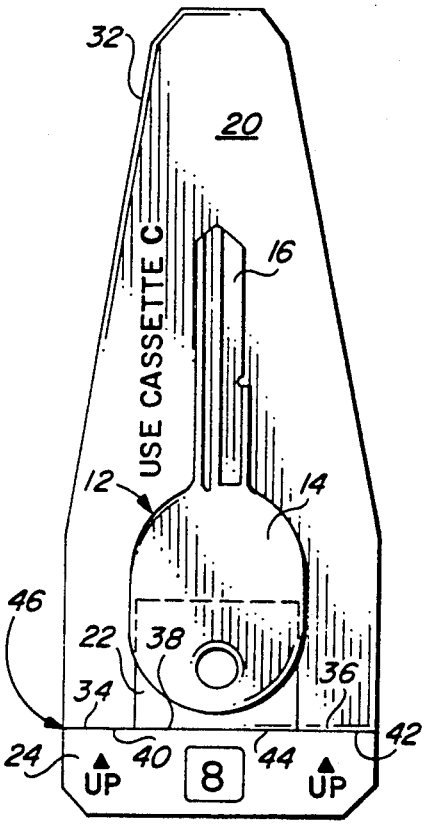
FIG. 3 is a view from above of the key storage tag illustrated in FIG. 1.

Referring now to FIGS. 1, 2 and 3, key storage tag 10 is designed to store a key blank 12 having a key head 14 and a key blade 16.

Figure 8:
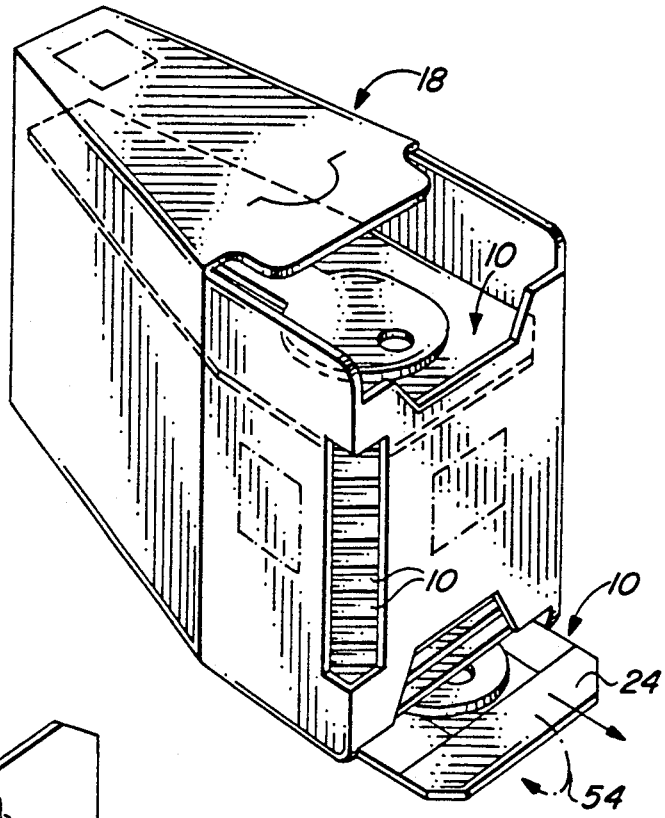
FIG. 8 is a perspective view of a key storage container configured to receive and store a plurality of key storage tags.

As illustrated in FIG. 8, a plurality of key storage tags 10 are designed to fit within an internal storage cavity of a key storage container 18. To facilitate such dimensional compatibility, the area of key storage tag 10 is configured to approximately equal or be slightly less than the cross sectional area of the internal storage cavity of key storage container 18 as illustrated in FIG. 8.

As illustrated in FIGS. 1, 2 and 3, key storage tag 10 includes a substantially planar tag main body 20, a key to tag interface 22 and a junction body 24.

Key storage tag 10 includes a longitudinal axis 26 which is typically laterally aligned with the longitudinal axis or centerline of key blank 12.

Key storage tag 10 also includes a lateral axis 28 which separates junction body 24 from tag main body 20 and key to tag interface 22.

FIG. 2 illustrates that means 30 serves to detachably couple key to tag interface 22 to the lower surface of the head 14 of key blank 12. In the preferred embodiment of the present invention, detachable coupling means 30 takes the form of a thin, substantially rectangular plastic sheet coated on both the upper and lower surfaces with an adhesive material to thereby adhesively couple key head 14 to the upper side of the plastic sheet and to similarly adhesively couple the lower surface of the plastic sheet to the upper surface of key to tag interface 22. In alternative embodiments of the invention, standardized double-sided adhesive tape or an area of solid or fluid adhesive without any related sheet material could also easily be substituted to serve as the detachable coupling means of the present invention. Preferably, the adhesive selected will be one which readily allows the key blank to be peeled away from the adhesive following termination of the key duplicating procedures.

As described in connection with FIG. 8, the key storage tag 10 as illustrated in FIG. 3 includes a perimeter 32 dimensioned to fit within the storage cavity of key storage container 18. As also shown, tag main body 20 is substantially planar and includes first and second spaced apart linear junction elements 34 and 36 which serve as an interface between tag main body 20 and junction body 24.

Key to tag interface 22 also includes a third junction element 38 which serves as an interface between key to tag interface 22 and junction body 24.

Although in FIG. 3, first, second and third junction elements 34, 36 and 38 are shown as running linearly from one edge of the tag to the opposite edge of the tag, these elements of the invention could be configured differently, potentially having shorter lengths with spaces in between the various elements or in various other configurations which would be readily apparent to one of ordinary skill in the art.

Junction body 24 includes corresponding junction interfaces designated as first junction segment 40, second junction segment 42 and third junction segment 44. Each of these junction segments of junction body 24 interface with and join the corresponding junction elements of key tag main body 20 and key to tag interface 22 as illustrated in the drawings.

Figure 4:
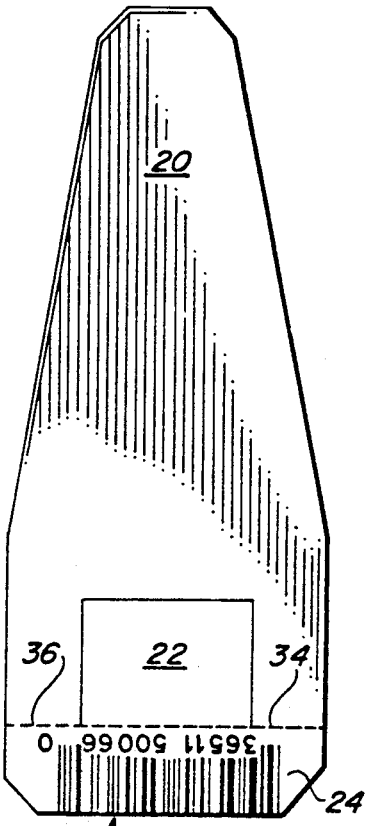
FIG. 4 is a view from below of the key storage tag illustrated in FIG. 1.
Figure 5:
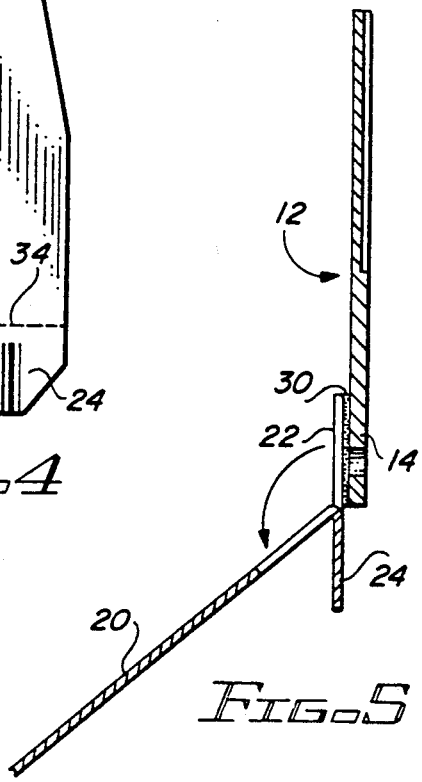
FIG. 5 is a side elevational view of the key storage tag illustrated in FIG. 1 showing the key storage tag deflected into the key duplication configuration relative to the key blank.
Figure 6:
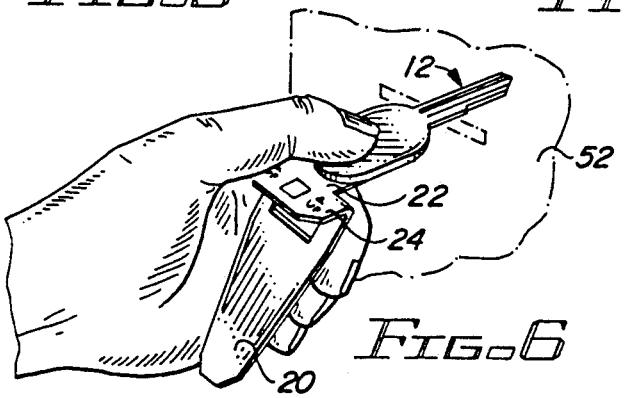
FIG. 6 illustrates the manner in which the key storage tag can be deflected into the key duplication configuration and inserted into a key duplication cassette of a key cutting machine.
Figure 9:
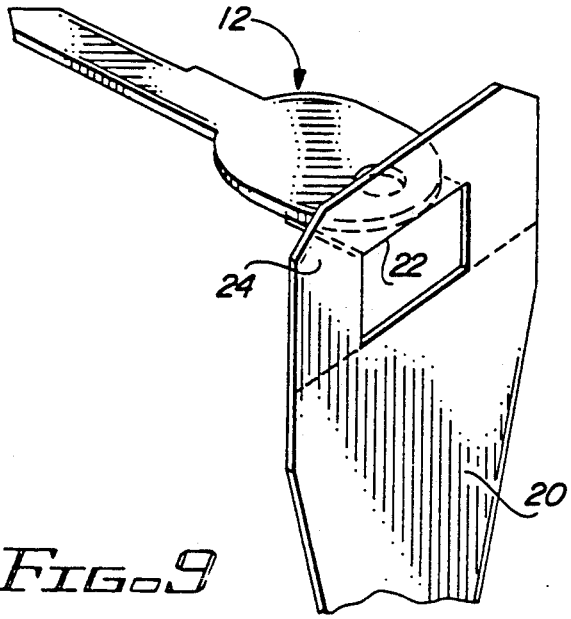
FIG. 9 illustrates a second embodiment of the invention including a hinge which pivots differently from the hinge illustrated in FIG. 6.

A hinge generally designated by reference number 46 is aligned with lateral axis 28 and enables the tag main body 20 to be deflected between a key blank storage configuration illustrated in FIGS. 1–4 where tag main body 20 is positioned substantially parallel to key blank 12 and a key duplication configuration illustrated in FIGS. 5, 6 and 9 wherein tag main body 20 is deflected away and separated from the lower surface of key blank 12.

As illustrated in FIGS. 6 and 9, manipulating the key storage tag into the key duplication configuration where the tag main body is deflected into a second plane and displaced away from the key to tag interface and the lower surface of the key blank while the key to tag interface is maintained within the first tag, opens a window within the perimeter of the key storage tag where the area of the window approximately the second area of the key to tag interface.

FIGS. 5 and 6 illustrate one specific configuration of hinge 46 in which key to tag interface 22 and junction body 24 remain in the same plane while tag main body 20 is angularly deflected relative to that plane.

In a second slightly different embodiment of the invention as illustrated in FIG. 9, the hinging action occurs in a different way which maintains tag main body 20 and junction body 24 in the same plane while the hinging action occurs by deflection of the key to tag interface 22 relative to those elements along the third junction element 38 and third junction segment 44.

Although either embodiment of the hinge of the present invention operates quite well, the preferred embodiment of the invention uses the hinging action illustrated in FIGS. 5 and 6.

Figure 7:
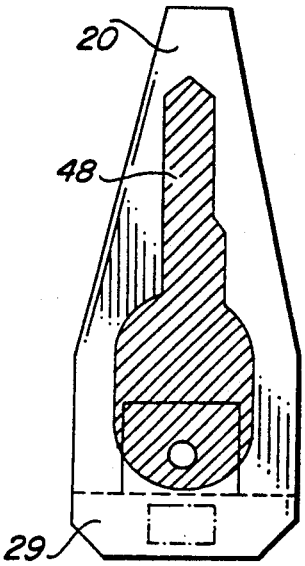
FIG. 7 is a view from above of the key storage tag illustrated in FIG. 1, showing the key blank removed from the key storage tag and particularly illustrating the key shape silhouette underlying the key blank.

As illustrated in FIG. 7, a black silhouette 48 is imprinted on the upper surface of tag main body 20 and key to tag interface 22 enabling a user to verify that the particular key blank affixed to that particular key storage tag does in fact have the correct configuration or silhouette as indicated by the key storage tag.

As illustrated in FIG. 4, the lower surface of junction body 24 includes a UPC code designated by reference number 50 for facilitating inventory control at the checkout counter or other point of sale.

As illustrated in FIG. 6, the key storage tag plus key blank combination of the present invention is primarily intended for use in a key duplication cassette 52 forming a part of a key cutting machine as disclosed in patent application Ser. No. 07/425,731, filed on 10/19/89, and entitled "KEY CUTTING MACHINE AND METHOD," the disclosure of which is incorporated by reference.

Because key cutting machine cassette 52 will accept a single-sided key blank as illustrated in FIG. 6 either with a correct or incorrect up/down orientation, it is important to assist the user in providing the proper key blank orientation as the key blank is inserted into cassette 52. To meet this objective as illustrated in FIG. 3, the upper surface of junction body 24 includes a pair of arrows indicating the way in which the key blank should be inserted into cassette 52 as well as the designation "Up" for the purpose of advising the user that this side of the key storage tag should be maintained "up" relative to the user to thereby ensure proper orientation of the key blank relative to the key cutting cassette 52.

An additional feature of the invention as illustrated in FIG. 3 is that junction body 24 of key storage tag 10 includes a numerical designation of the key blank affixed to the tag or, as illustrated in FIG. 3, key blank number "8."

During the key duplicating process, an operator determines the proper key blank number and accesses the key storage container 18 which prominently displays the same key blank numerical code in a visible position on the exterior surface of key storage container 18. The operator then merely reaches up, grasps the edge of junction body 24 and removes the selected key storage tag 10 from key storage container 18 as illustrated in FIG. 8. Due to the stacked relationship of the plurality of key storage tags 10 with key blanks as illustrated in FIG. 8, the next key storage tag becomes immediately available for selection and use.

To facilitate gripping of the key storage tag and its removal from key storage container 18, the entire hinged junction 46 between junction body 24, tag main body 20 and key to tag interface 22 is creased or lightly scored. This particular configuration of the invention allows the entire junction body 24 to be deflected downwardly as illustrated in FIG. 2 during the key storage tag removal process as illustrated in FIG. 8. The arrow designated by reference number 54 in FIG. 8 illustrates the manner in which junction body 24 is downwardly deflected as the entire key storage tag 10 is removed from key storage container 18.

Key storage tag 10 is typically manufactured from a single sheet of material, preferably a single sheet of stiff paper or cardboard, fairly thin in depth as illustrated in FIGS. 2 and 5. Alternatively, key storage tag 10 could be fabricated from other more durable, but more costly materials such as plastic as well as numerous other materials.

The desired operation of hinge 46 is facilitated by appropriate placement of scoring lines along lateral axis 28 to accomplish the desired modes of deflection as described above. As clearly illustrated in FIG. 6, hinge 46 is structured so that a key duplication machine operator can, without physical restriction from either tag main body 20 or key to tag interface 22, grip both the upper and lower sides of key blank 12.

During key duplication operations, tag main body 20 can either be deflected ninety degrees, one hundred and eighty degrees or any other relative deflection away from the key blank 12. The key storage tag 10 thus remains attached to key blank 12 during key duplication operations and during the subsequent sale transaction to assist the operator in maintaining the key blank with the proper orientation relative to cassette 52 and to facilitate a cashier in scanning the key storage tag UPC code. By design, key storage tag 10 will typically not be removed by the customer until after the sale and payment transactions have been completed.

After removal of the key storage tag 10 and key blank 12 from key storage container 18, the operator can readily replace the key storage tag 10 with key blank 12 back into key storage container 18 if a selection error has been made. To facilitate this operation, the upper front surface of key storage container 18 is left open to receive unused key storage tags.

As illustrated in the drawings, the perimeter of key blank head 14 is typically centered about the intersection of the longitudinal and lateral axes 26 and 28 of key storage tag 10 with the edge of key head 14 placed in close proximity to hinge line 46. This configuration is maintained regardless of the relative physical size of key blank 12, its head 14 or its blade 16. The only constraint is that the overall size and area of key blank 12 not exceed the overall area of the combined surfaces of tag main body 20 and key to tag interface 22.

A direct result of these unique structural limitations is that key blanks having a virtually unlimited number of different geometric configurations can be secured to and used with key storage tag 10 which utilizes a single size, shape and area configuration entirely compatible with the interior dimensions of key storage container 18 as illustrated in FIG. 8.

In alternative embodiments of the present invention, hinge 46 could be fabricated differently, but such different configurations would typically require more complex structure involving higher cost manufacturing operations. For example, a conventional hinge structure as used in the doors of domestic homes including a shaft and alternating cylindrical elements maintained in alignment as is the case with a piano hinge could be substituted for hinge 46. Rather than having the particular linear hinge configuration illustrated in the drawings, hinge 46 could be configured to have a serrated edge or another shape as long as the hinge structure maintained the ability to provide the required relative deflection between various elements of key storage tag 10 as described above.

As shown in the drawings, the longitudinal axis of the key blank has been maintained generally parallel with and in fact centered about longitudinal axis 26 of key storage tag 10. Although this configuration represents the preferred embodiment of the invention, the key blank could be skewed relative to key storage tag 10. In other embodiments of the invention, key to tag interface 22 could be laterally displaced away from the centerline of key storage tag 10 without deviating from the scope of the invention as claimed. Numerous other such minor modifications of the structure of the preferred embodiment of the invention as described above could readily be implemented by one of ordinary skill in the art while still practicing the invention disclosed and claimed herein. Accordingly, it is intended by the appended claims to cover all such modifications of the invention which fall within the true spirit and scope of the invention.

We claim:

1. In combination a key storage tag which stores a key blank having a defined area, a head with upper and lower surfaces and a blade with upper and lower surfaces; said key storage tag and said key blank capable of being housed in a key storage container having an internal storage cavity with a cross sectional area the key storage tag including a longitudinal axis and comprising:

a. a substantially planar tag main body having a first area with a perimeter edge dimensioned to fit within the storage cavity of the key storage container and including first and second spaced apart linear junction elements;

b. a substantially planar key to tag interface having a second area and including means for detachably coupling the interface to the lower surface of the key head and a third junction element, the key to tag interface extending below and overlapping a portion of the key head;

c. a substantially planar junction body having a third area and a linear junction surface defining a lateral axis perpendicular to the longitudinal axis of the key storage tag, the junction surface including spaced apart first and second junction segments aligned with the lateral axis for joining the junction body to the first and second junction elements of the tag main body and a third junction segment positioned between and aligned with the first and second junction elements for joining the junction body to the third junction element of the key to tag interface, the tag main body, the key to tag interface and the junction body defining a continuous perimeter of the key storage tag with the tag main body lying on a first side of the lateral axis and the junction body lying on a second side of the lateral axis; and d. a hinge aligned with and moveable about the lateral axis of the key storage tag for enabling the tag main body to be deflected about the lateral axis between a key blank storage configuration where the tag main body, key to tag interface and junction body all lie within a first plane and are positioned substantially parallel to and below the key blank and a key duplication configuration where the tag main body is deflected into a second plane displaced away from the key to tag interface and the lower surface of the key blank while the key to tag interface is maintained within the first plane, thereby opening a window within the perimeter of the key storage tag.

2. The key storage tag of claim 1 wherein the window defines an area substantially equal to the second area.

3. The key storage tag of claim 2 wherein the tag main body, the key to tag interface and the junction surface are fabricated from a single material.

4. The key storage tag of claim 3 wherein the tag main body, the key to tag interface and the junction surface are fabricated from a single sheet of the single material.

5. The key storage tag of claim 4 wherein the tag main body, the key to tag interface and the junction surface are fabricated from a single sheet of stiff paper.

6. The key storage tag of claim 1 wherein the detachable coupling means includes an adhesive material disposed between the key to tag interface and the lower surface of the key head.

7. The key storage tag of claim 1 wherein the head of the key blank includes an area and wherein the detachable coupling means includes a sheet of material having an area less than the area of the key head and further includes first and second opposing surfaces coated with an adhesive.

8. The key storage tag of claim 1 wherein the key blank includes a longitudinal axis oriented parallel to the longitudinal axis of the key storage tag.

9. The key storage tag of claim 8 wherein the key blank longitudinal axis is laterally aligned with the longitudinal axis of the key storage tag.

10. The key storage tag of claims 1 or 9 wherein the key blank head overlaps both the tag main body and the key to tag interface.

11. The key storage tag of claim 10 wherein the key blank head does not overlap the junction body of the key storage tag.

12. The key storage tag of claim 11 wherein the key blank head includes a perimeter surface extending in close proximity to the intersection of the lateral and longitudinal axes of the key storage tag.

13. The key storage tag of claims 1 or 9 wherein the hinge includes a first hinge element forming a part of the first junction element of the tag main body and the first junction segment of the junction body and a second hinge element forming a part of the second junction element of the tag main body and the second junction segment of the junction body.

14. The key storage tag of claim 13 wherein the tag main body, the key to tag interface and the junction body are formed from a single sheet of stiff paper and wherein the first and second hinge elements include creases in the paper.

15. The key storage tag of claim 14 wherein the first and second hinge elements include score lines in the paper.

16. The key storage tag of claim 13 wherein the hinge includes a third hinge element forming a part of the third junction element of the key to tag interface and the third junction segment of the junction body.

17. The key storage tag of claim 16 wherein the tag main body, the key to tag interface and the junction body are formed from a single sheet of stiff paper and the hinge is formed by a crease in the paper between the third junction element and the third junction segment.

18. The key storage tag of claim 17 wherein the hinge includes a score line in the third junction element.

19. The key storage tag of claim 1 wherein the sum of the first, second and third areas is equal to or less than the cross sectional area of the storage cavity of the key storage container.

20. The key storage tag of claim 19 wherein the key blank area is less than the sum of the first and second areas.

21. The key storage tag of claims 1 or 20 wherein the key blank includes a length, wherein the tag main body includes a length and wherein the length of the key blank is less than the length of the tag main body.

22. The key storage tag of claim 21 wherein the key to tag interface includes a length and wherein the length of the key blank is greater than the length of the key to tag interface.

23. The key storage tag of claim 13 wherein the key blank includes a longitudinal axis and wherein the hinge allows the key to tag interface and the junction body to remain parallel to the longitudinal axis of the key blank as the tag main body is deflected between the key blank storage configuration and the key duplication configuration.

24. The key storage tag of claim 1 wherein the hinge when in the key blank storage configuration allows the junction body to be downwardly deflected relative to the longitudinal axis without deflecting the tag main body, the key to tag interface and the key blank to facilitate gripping of the junction body and to facilitate removal of the key storage tag from the key storage container.

25. The key storage tag of claim 1 wherein the tag main body includes an upper surface including a silhouette of the key blank.

26. The key storage tag of claim 25 wherein the key blank is aligned with the silhouette.

27. The key storage tag of claim 1 wherein the junction body includes a surface having a UPC code.

28. The key storage tag of claim 1 wherein the junction body includes a surface having a key blank identification symbol.

* * * * *